US011885247B2

(12) United States Patent
Covino

(10) Patent No.: US 11,885,247 B2
(45) Date of Patent: Jan. 30, 2024

(54) OIL DRAINAGE APPARATUS

(71) Applicant: Daniel Joseph Covino, Redwood City, CA (US)

(72) Inventor: Daniel Joseph Covino, Redwood City, CA (US)

( * ) Notice: Subject to any disclaimer, the term of this patent is extended or adjusted under 35 U.S.C. 154(b) by 0 days.

(21) Appl. No.: 17/885,668

(22) Filed: Aug. 11, 2022

(65) Prior Publication Data

US 2023/0061217 A1 Mar. 2, 2023

Related U.S. Application Data

(60) Provisional application No. 63/236,980, filed on Aug. 25, 2021.

(51) Int. Cl.
*F01M 11/04* (2006.01)

(52) U.S. Cl.
CPC ..... *F01M 11/0408* (2013.01)

(58) Field of Classification Search
CPC ..... F01M 2011/0416; F01M 11/0408
See application file for complete search history.

(56) References Cited

U.S. PATENT DOCUMENTS 1,806,001 A * 5/1931 Frederick ..... B03C 1/28 184/6.25
3,955,648 A * 5/1976 Walker, Jr. ..... B60R 17/00 184/105.3
5,433,410 A * 7/1995 Foltz ..... F16K 3/26 251/351
7,146,870 B2 * 12/2006 Kuo ..... F16C 33/6651 74/89.44
11,415,488 B2 * 8/2022 Marchand ..... F01M 11/0408
2006/0054402 A1 * 3/2006 Dorian ..... B03C 1/286 184/1.5
2007/0262028 A1 * 11/2007 Flaherty ..... B03C 1/286 210/695
2019/0120731 A1 * 4/2019 Marchand ..... G01N 1/2035
2023/0061217 A1 * 3/2023 Covino ..... F01M 11/0408

* cited by examiner

*Primary Examiner* — Michael A Riegelman
(74) *Attorney, Agent, or Firm* — Dale J. Ream

(57) ABSTRACT

An oil drainage apparatus includes a base member defining an interior area and a laterally extending selector channel. A connection tube extends upwardly from the base for connection to the oil drainage port of an engine. An oil drainage body extends upwardly from the connection member and has apertures in fluid communication with the oil pan. Drainage of oil from the engine's oil pan is regulated by a positioning of magnets. A drain magnet is vertically movable inside the drainage body and movable between a closed configuration blocking the plurality of apertures and an open configuration displaced therefrom. An actuation lever is laterally movable to align either a first or second actuation magnet beneath the drain magnet, one of the actuation magnets having a polarity to attract and close the drain magnet and the other having a polarity which pushes away and opens the drain magnet to allow drainage.

19 Claims, 7 Drawing Sheets

OIL DRAINAGE APPARATUS

REFERENCE TO RELATED APPLICATIONS

This application is a non-provisional patent application that claims the priority of provisional patent application 63/236,980 filed Aug. 25, 2021 titled Permanent Oil Drain Valve Actuated by Magnet Traction/Repulsion. This application is related to application Ser. No. 13/111,045 filed May 19, 2011 titled Oil Drainage Apparatus, now U.S. Pat. No. 8,544,606.

BACKGROUND OF THE INVENTION

This invention relates generally to automotive accessories and, more particularly, to an oil drainage apparatus configured to be mounted to an oil pan drainage outlet or port of an automobile engine.

Changing the oil in an automobile is a common practice by vehicle owners and one that is advisable and necessary in order to maintain good engine operation. The task of changing oil, however, is one that is frequently delegated to car dealership mechanics or auto repair shops in that the usual oil changing process is dirty, inconvenient, and will result in future leakage if not carried out competently. The oil changing process requires the automobile to be either jacked up or for the person changing the oil to slide underneath the car. An oil pan drainage plug is accessible underneath the car and must be removed in order to drain the oil from the oil pan. Removing the plug may result in the mechanic's fingers becoming oily or in oil being released before a collection container can be moved into place, resulting in a mess on the mechanic's hands or, worse yet, all over the floor.

Various oil plugs have been proposed to simplify the process of changing and engine's oil. Although presumably effective, the existing products are either not permanently mounted to an oil pan, are not convenient to mount or use, or do not result in an efficient means for changing an engine's oil.

Therefore, it would be desirable to have an oil drainage apparatus that replaces a traditional engine threaded bolt oil pan plug and which selectively drains oil from the oil pan merely by operating a lever. Further, it would be desirable to have an oil drainage apparatus that includes a slidable lever that causes oil to drain when slidably locked in one direction and that automatically returns to a sealed configuration when slidably locked in the opposite direction. In addition, it would be desirable to have an oil drainage apparatus having an inner drainage tube that uses magnetic attraction and repulsion to regulate when oil is allowed to drain.

SUMMARY OF THE INVENTION

An oil drainage apparatus for use with an engine that includes an oil pan and an oil drainage port that is threaded includes a base member that includes a housing defining an interior area and a selector channel extending laterally between opposed left and right ends. A connection tube extends upwardly from the housing and has threads complementary to those of the oil drainage port of the engine. An oil drainage body extending upwardly from the connection member and having a continuous sidewall defining a plurality of apertures in fluid communication with the oil pan of the engine.

A drainage of oil from the engine's oil pan through the oil drainage body apertures is regulated by a user selected positioning of magnets. A drain magnet is slidably movable in the common internal tubular space between a closed configuration blocking the plurality of apertures and an open configuration displaced from the plurality of apertures. A first actuation magnet is movably mounted in the interior area of the base member and includes a first predetermined polarity that is opposite to a polarity of the drain magnet. Similarly, a second actuation magnet use movably mounted in the interior area but has a second predetermined polarity that is the same as that of the drain magnet polarity.

In an important aspect, and actuation lever is pivotally mounted in the interior area of the base member and includes an elongate and linear configuration that extends outwardly through the selector channel and that is coupled to the first and second actuation magnets, the actuation lever being selectively and slidably movable along the selector channel between a closed configuration situated proximate the left end at which the first actuation magnet is aligned with the drain magnet and an open configuration situated proximate the right end such that the second actuation magnet is vertically aligned with drain magnet.

Therefore, a general object of this invention is to provide an oil pan drainage apparatus that permanently replaces a conventional oil pan drainage plug and which caused the oil pan to drain with a single manipulation of a lever Another object of this invention is to provide an oil pan drainage apparatus, as aforesaid, that includes a lever that is pivotally movable position a selected actuation magnet into alignment with a drain magnet that either blocks or allows oil drainage.

Still another object of this invention is to provide an oil pan drainage apparatus, as aforesaid, that is easy to install and economical to use Yet another object of this invention is to provide an oil pan drainage apparatus, as aforesaid, that has a low-profile configuration so as to minimize the risk of being damaged by object passing underneath the vehicle while driving.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
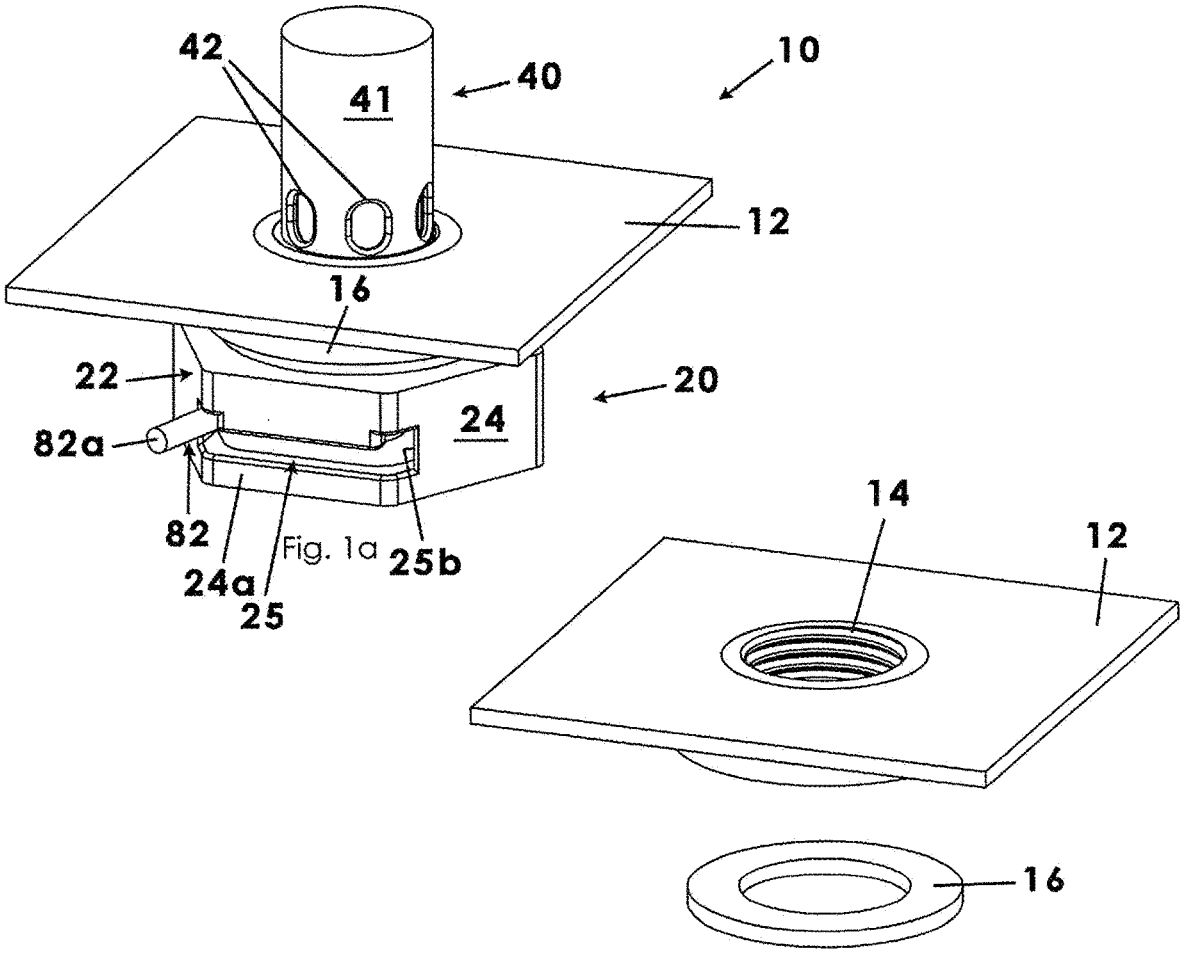
FIG. 1*a* is a perspective view of an oil change apparatus according to a preferred embodiment of the present invention, illustrated installed in an oil pan of an engine.
Figure 1B:
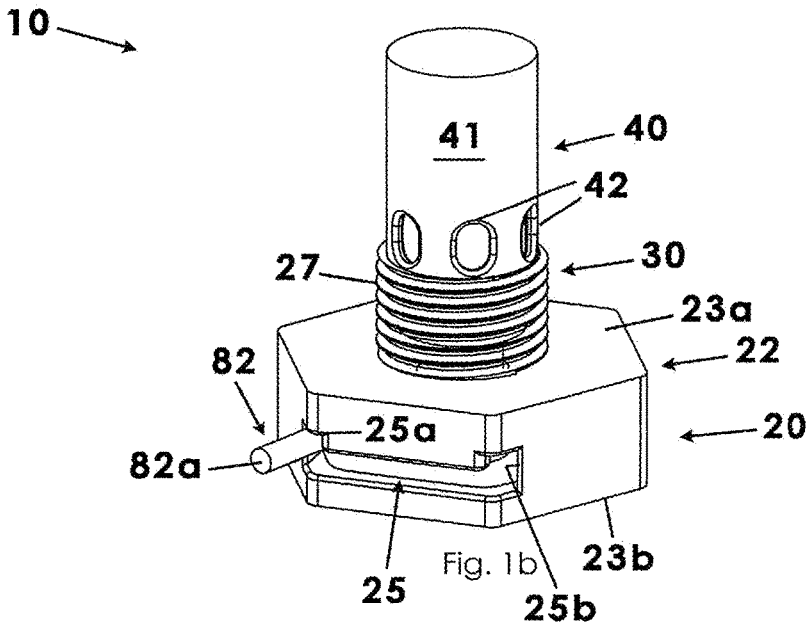
FIG. 1*b* is an exploded view of the oil change apparatus as in FIG. 1*a;*
Figure 2A:
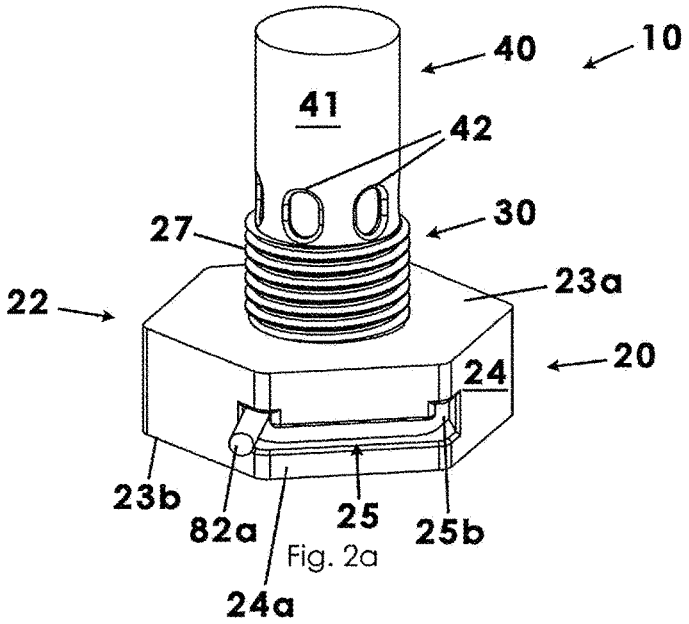
FIG. 2*a* is a front view of the oil change apparatus as in FIG. 1*a*, illustrated removed from the engine and with the actuation lever in a first locked configuration.
Figure 2B:
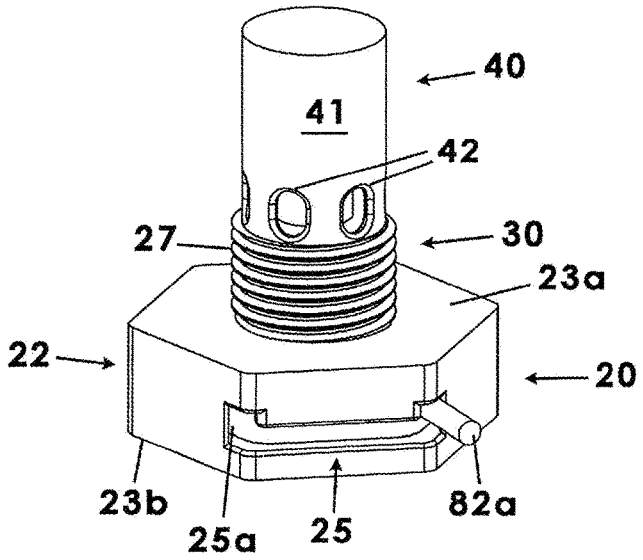
FIG. 2*b* is a front view of the oil change apparatus as in FIG. 2*a*, illustrated with the actuation lever in a second locked configuration.
Figure 3:
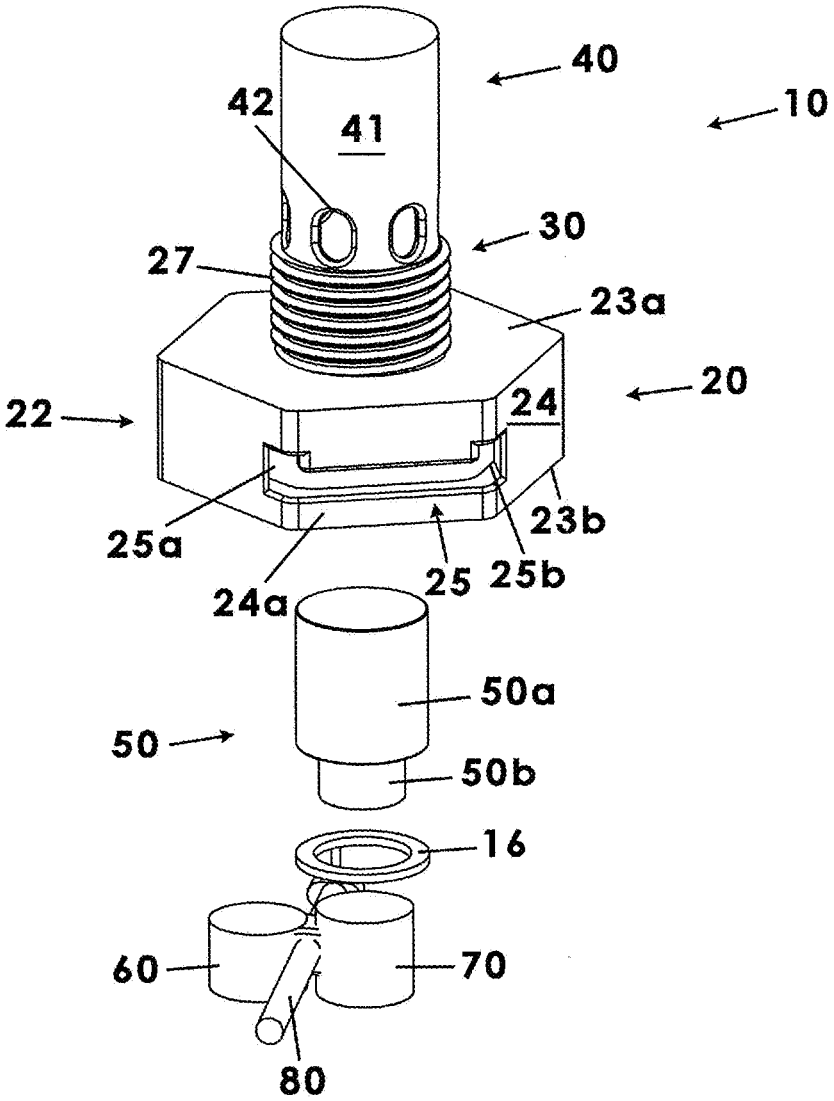
FIG. 3 is an exploded view of the oil change apparatus as in FIG. 2*a;*

An oil drainage apparatus according to a preferred embodiment of the present invention will now be described with reference to FIG. 1*a* to 7*c* of the accompanying drawings. The oil drainage apparatus 10 includes a base member 20 that defines a selector channel 25, a connection member 30, and oil drainage body 40, a drain magnet 50, a first actuation magnet 60, a second actuation magnet 70 and an actuation lever 80 that is slidably movable along the selector channel 25 whereby to selectively align the first or second actuation magnet with the drain magnet 50. Preferably, the oil drainage apparatus 10 may be permanently or semi-permanently attached to an oil drainage port 14 of an oil pan 12 associated with an automobile engine. In other words, the traditional bolt that regulates oil drainage in an oil pan of a motor may be removed and replaced by the threaded connection member 30 and then future oil changes being regulated by operation of the oil drainage apparatus 10 as described below. It is understood that this union may be sealed with a gasket 16 (FIGS. 1*a* and 1*b*).

The base member 20 is, essentially, a housing 22 preferably having an octagonal configuration although a circular, square, or other geometric configurations may also work. More particularly, the housing 22 may include a top wall 23*a* and a bottom wall 23*b* that is opposite and parallel to the top wall 23*a*. Similarly, the housing 22 may include a continuous sidewall 24 or, alternatively, multiple sidewalls, each extending between the top wall 23*a* and bottom wall 23*b*. Together, the multiple walls of the housing 22 may define an interior area which may contain other key components of the invention as will be described later. In an embodiment, the continuous sidewall 24 includes a front wall section 24*a* that defines the selector channel 25. More particularly, the selector channel 25 is, essentially, a horizontal slot that extends laterally and defines an imaginary horizontal axis, the selector channel 25 being in communication with the interior area and bounded at one end (a "left end") by a left locking slot 25*a* and at an opposed end (a "right end") by a right locking slot 25*b*. Preferably, the locking slots are each perpendicular relative to the selector channel 25, each extending upwardly to an upper end, respectively, and each defining an imaginary vertical axis that is perpendicular to the imaginary horizontal axis defined by the selector channel 25.

In an embodiment, a connection member 30 having a tubular configuration extends upwardly from the top wall 23*a* and includes a threaded outer surface 27 that is complementary to a thread pattern defined by the oil drainage port 14 associated with the oil pan 12 and engine for permanent or semi-permanent attachment thereto (not shown). The connection member 30, having a tubular configuration, defines an open interior space.

Further, the oil drainage apparatus 10 includes an oil drainage body 40 having a continuous sidewall 41 extending upwardly from the connection member 30, the oil drainage body having a tubular configuration also defining an interior space. The continuous sidewall 41 defines a plurality of apertures 42 through which oil from the oil pan associated with the engine may flow when the connection member 30 is threadably coupled to the oil pan as described above and the drain magnet 50 is properly displaced from the apertures 42 as will be described below. Together, the interior spaces defined by the connection member 30 and oil drainage body 40 together define a channel that will be referred to as a common internal tubular space 44.

In a critical aspect, the oil drainage apparatus 10 includes the drain magnet 50 that is positioned and slidably movable within the common internal tubular space 44 when actuated, i.e., when attracted or repulsed by respective polarities of the first actuation magnet 60 or second actuation magnet 70, respectively, as will be discussed later in more detail. More particularly, the drain magnet 50 may be moved vertically (i.e., upwardly or downwardly) within the common internal tubular space 44 between a closed configuration that blocks the plurality of apertures 42 and an open configuration that is displaced from the plurality of apertures 42. Stated another way, the drain magnet 50 is actuated to either prevent oil from flowing through the apertures 42 (i.e., prevent drainage of oil from the oil pan) or to allow oil flow through the apertures 42 (i.e., permit drainage of oil from the oil pan). To better facilitate the functionality described above, the drain magnet 50 and a lower section 30*a* of the connection member 30 may include a complementary construction. More particularly, the drain magnet 50 has a tubular configuration and may include an upper portion 50*a* that has an outer diameter equal to an inner diameter of the connection member 30 and drainage body 40 (which, together, define the common internal tubular space). Specifically, the connection member 30 may define an open top while the oil drainage body 40 includes an open bottom such that there is fluid communication between the connection member 30 and oil drainage body 40.

Figure 4A:
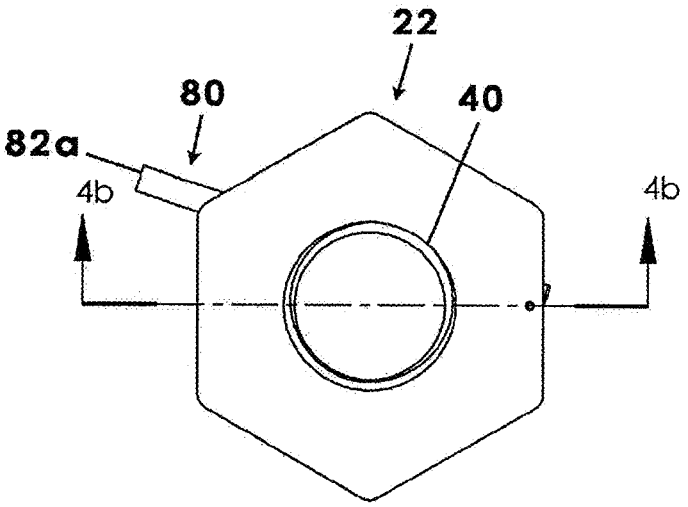
FIG. 4*a* is a top view of the oil change apparatus as in FIG. 2*a*
Figure 4B:
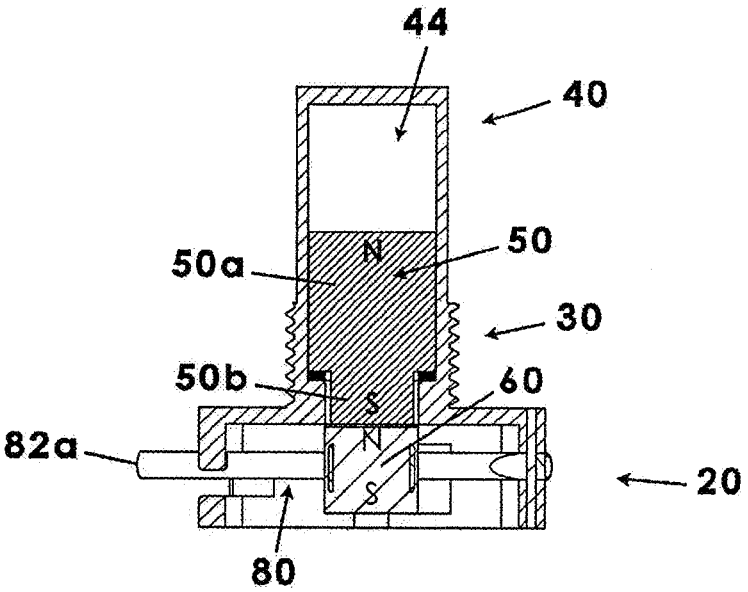
FIG. 4*b* is a sectional view taken along line 4*b*-4*b* of FIG. 4*a*, schematically illustrating a drain magnet in a downwardly positioned and magnetically attracted configuration that prevents drainage of oil according to the present invention.
Figure 5A:
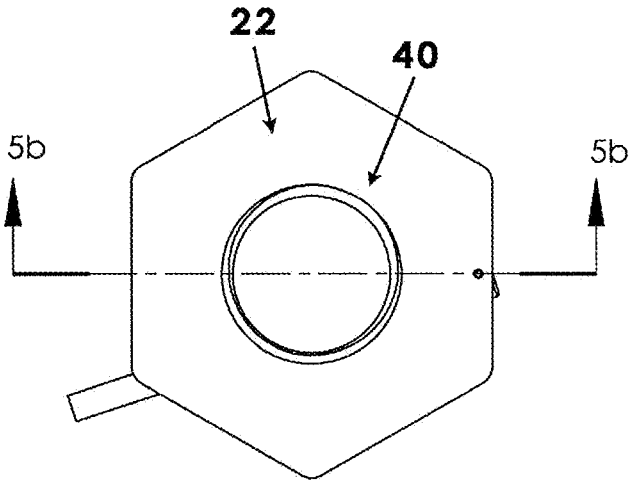
FIG. 5*a* is a top view of the oil change apparatus as in FIG. 2*b;*
Figure 5B:
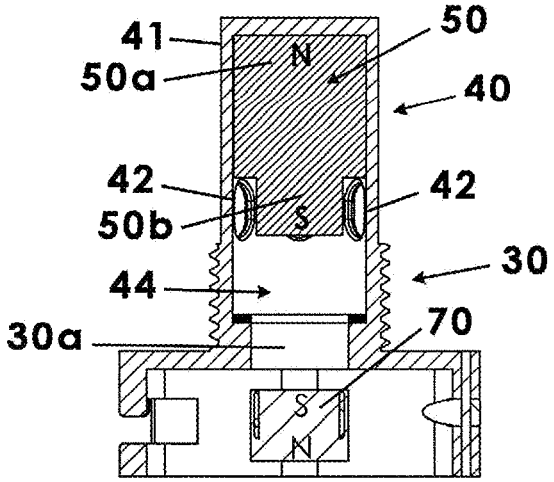
FIG. 5*b* is a sectional view taken along line 5*b*-5*b* of FIG. 5*a*, schematically illustrating a drain magnet in a upwardly positioned and magnetically repulsed configuration that allows drainage of oil according to the present invention.
Figure 6A:
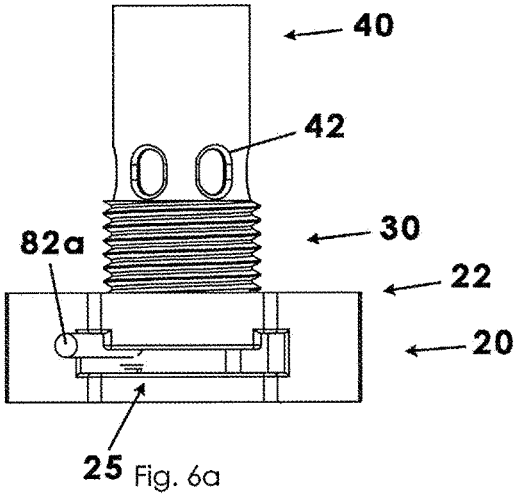
FIG. 6*a* is a front view of the oil change apparatus as in FIG. 2*a*, illustrated with the actuation lever in a left locking slot.
Figure 6B:
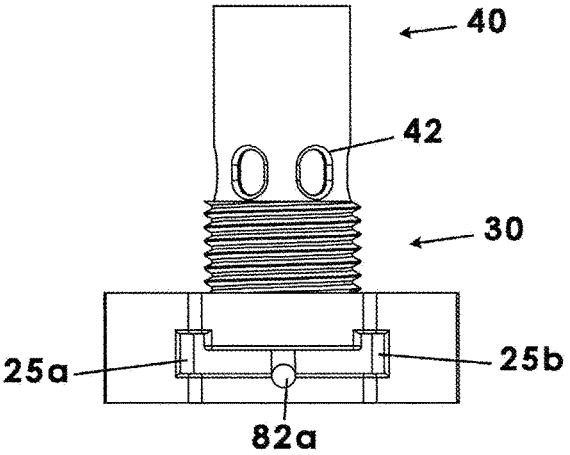
FIG. 6*b* is a front view of the oil change apparatus as in FIG. 6*a*, illustrated with the actuation lever and an intermediate position.
Figure 6C:
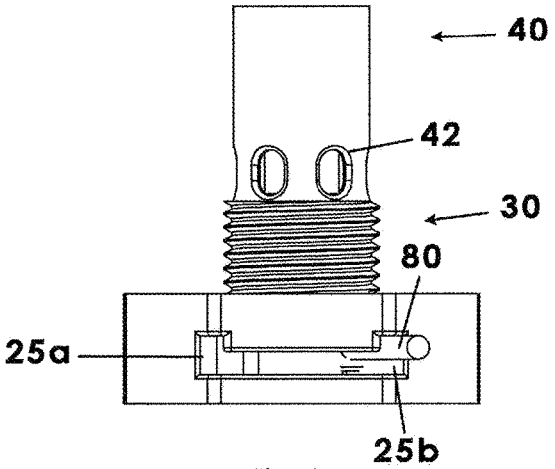
FIG. 6*c* is a front view of the oil change apparatus as in FIG. 6*a*, illustrated with the actuation lever and a right walking slot.

Further, the drain magnet 50 may include a lower portion 50*b* that depends from a lower edge of the upper portion 50*a* and which has a smaller diameter that is configured to nest within the lower section 30*a* of the connection member 30 (FIGS. 4*b* and 5*b*). Consequently, oil is better able to flow through the apertures 42 when the drain magnet 50 is repulsed to an upward open configuration (FIG. 5*b*). Importantly, the drain magnet 50 is characterized as having a magnetic polarity. In other words, the drain magnet will either be attracted to another magnet or repulsed away from another magnet depending on the respective polarities of each. As shown in the accompanying illustrations, the drain magnet 50 may have North and South poles and referred to as having a N-S polarity which is illustrated with the North Pole being upward and the South Pole being downward as shown best in FIGS. 4*b* and 5*b*.

In another aspect, the oil drainage apparatus 10 includes an actuation lever 80 having an elongate and linear configuration and having opposed front 82*a* and 82*b* rear ends. More particularly, the rear end 82*b* may be pivotally mounted to and inner surface of a rear wall section 24*b* of the continuous side wall 24 such that the actuation lever 80 is selectively movable side to side (i.e., laterally) along the selector channel 25 and between its opposed ends as described previously. The front end 82*a* extends outwardly through the selector channel 25. In an embodiment, the actuation lever 80 includes a semi-flexible construction that may be manually depressed (i.e., the front end 82*a* may be manually pressed downwardly by a user) and is resilient to return to its normal linear configuration when the downward pressure is removed. In use, the front end 82*a* has a normal bias to nest adjacent the upper ends of the left or right locking slots 25*a*, 25*b*, respectively; however, the front end 82*a* may be pressed downwardly so as to escape or be removed from respective locking slots and then while traveling along the selector channel 25. Stated another way, the front end 82*a* must first be flexed downwardly to be received into the selector channel 25, the actuation lever 80 being resilient and automatically locked again when the front end 82*a* reaches an opposed locking slot. Geometrically, the actuation lever 80 becomes co-linear with the imaginary horizontal axis defined by the selector channel 25 within the front end 82*a* is flexed downwardly. The actuation lever 80 is coupled to the first and second actuation magnets 60, 70 and operatively capable of aligning that actuation magnets beneath the drain magnet 50 whereby to attract or repulsed the drain magnet 50 as will be described below.

In a critical aspect, the oil drainage apparatus 10 includes a first actuation magnet 60 that is positioned in the interior area of the base member 20, is coupled to the actuation lever 80 and is slidably movable when actuated by corresponding movement of the actuation lever 80. Importantly, the first actuation magnet 60 has a magnetic polarity that is oriented so as to be attracted to the drain magnet 50. This circumstance will be described as the first actuation magnet 60 having a magnetic polarity that is opposite that of the drain magnet 50. It is understood that while the polarity of the first actuation magnet 60 may also be a N-S polarity, its orientation is such that the South Pole of the drain magnet 50 is adjacent the North Pole of the first actuation magnet 60 such that the two magnets are attracted to one another as shown in FIG. 4*b*.

Similarly, the oil drainage apparatus 10 includes a second actuation magnet 70 that is positioned in the interior area of the base member 20, is coupled to the actuation lever 80 and is slidably movable when actuated by corresponding movement of the actuation lever 80. Importantly, the second actuation magnet 70 has a magnetic polarity that is oriented so as to repulse (i.e., push away) the drain magnet 50. This circumstance will be described as the second actuation magnet 70 having a magnetic polarity that is the same as that of the drain magnet 50. It is understood that while the polarity of the second actuation magnet 70 may be a S-N polarity, its orientation is such that the South Pole of the drain magnet 50 is adjacent the South Pole of the second actuation magnet 70 such that the two magnets are pushed away from one another as shown in FIG. 5*b*. Specifically, in this case, the drain magnet 50 is repulsed and pushed upwardly toward the open configuration that allows oil to flow through the apertures 42 and be drained from the oil pan 12.

Figure 7A:
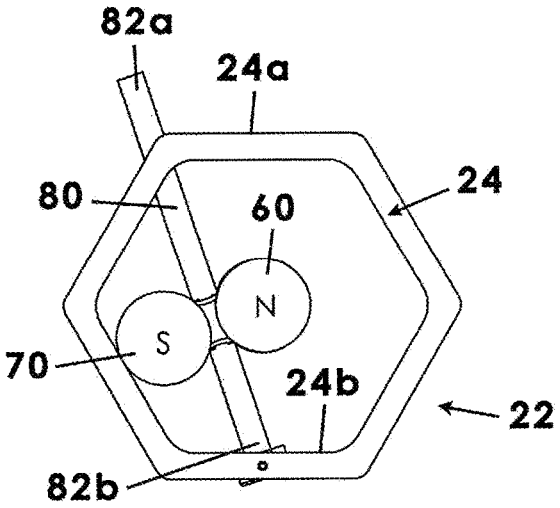
FIG. 7*a* is a diagram of the oil change apparatus as in FIG. 6*a;*
Figure 7B:
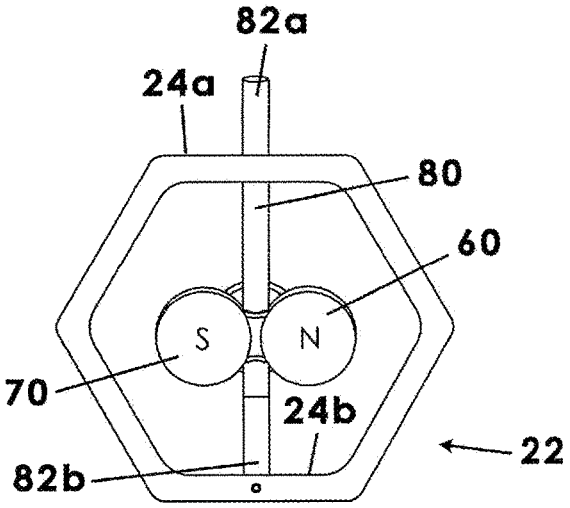
FIG. 7*b* is a diagram of the oil change apparatus as in FIG. 6*b*.
Figure 7C:
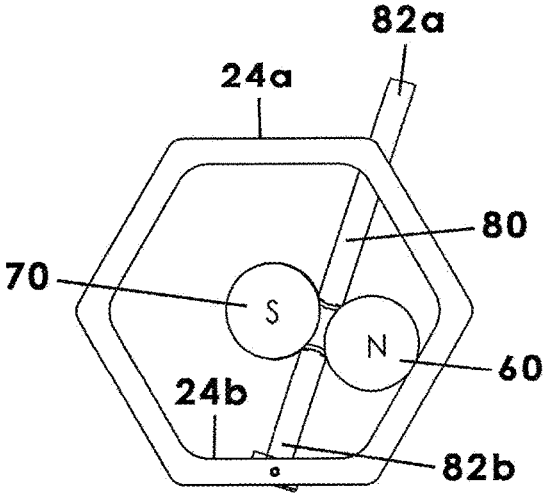
FIG. 7*c* is a diagram of the oil change apparatus as in FIG. 6*c.*

With regard to FIGS. 7*a* to 7*c*, the first actuation magnet 60 and the second actuation magnet 70 are positioned laterally adjacent one another within the interior area of the housing and are each coupled to the actuation lever 80. Positioning the actuation lever 80 in a first respective locking slot causes an associated actuation magnet to be aligned with the drain magnet 50 (FIG. 7*a*). Conversely, positioning the actuation lever 80 in a second respective slot causes an associated actuation magnet to be aligned with the drain magnet 50 (FIG. 7*c*). And, to be complete, when the actuation lever 80 is traveling along the selector channel 25, neither actuation magnet is aligned with the drain magnet 50. Applying the polarity descriptions from above, the drain magnet 50 is either moved downwardly by magnetic attraction so as to prevent oil drainage or moved upwardly by magnetic repulsion so as to allow oil drainage.

In use, the oil drainage apparatus 10 may be coupled to the oil pan drainage port 14 of an automobile engine. Specifically, the threaded exterior surface of the connection member 30 may be threadably coupled to the inner threaded surface of the drainage port 14. When a user desires to drain the oil from the oil pan, the user may depress/actuate the actuation lever 82 to align a respective one of a pair of actuation magnets 60, 70 into alignment with a drain magnet 50 whereby respective polarities will either attract or repulse the drain magnet 50. In the repulsed or open configuration, oil from the oil pan 12 may flow through the apertures 42 of the oil drainage body 40. The oil is free to flow by the force of gravity downward through the tubular space defined by the connection member 30 and oil drainage body 40. The drained oil, of course, may be collected in a container for disposal. It should also be appreciated that the entire apparatus may be removed from the oil pan drainage port if further cleanout of the oil pan is desired.

It is understood that while certain forms of this invention have been illustrated and described, it is not limited thereto except insofar as such limitations are included in the following claims and allowable functional equivalents thereof.

The invention claimed is:

1. An oil drainage apparatus for use with an engine that includes an oil pan and an oil drainage port that is threaded, said oil drainage apparatus, comprising:

a base member including a housing having a plurality of walls defining an interior area and a selector channel extending laterally between opposed left and right ends;

a connection member extending upwardly from said base member and having a plurality of external threads complementary to the threaded oil drainage port;

an oil drainage body extending upwardly from said connection member and having a continuous sidewall defining a plurality of apertures in fluid communication with the oil pan of the engine;

wherein said connection member and said oil drainage body define and share a common internal tubular space in fluid communication with said interior area of said base member;

a drain magnet slidably movable in said common internal tubular space between a closed configuration blocking said plurality of apertures and an open configuration displaced from the plurality of apertures;

wherein said drain magnet has a drain magnet polarity;

a first actuation magnet movably mounted in said interior area of said base member having a first predetermined polarity that is opposite to said drain magnet polarity;

the second actuation magnet movably mounted in said interior area of said base member having a second predetermined polarity that is the same as that drain magnet polarity;

an actuation lever pivotally mounted in said interior area of said base member and that includes an elongate and linear configuration that extends outwardly through said selector channel and that is coupled to said first and second actuation magnets, said actuation lever being selectively and slidably movable along said selector channel between a closed configuration situated proximate said left end at which the first actuation magnet is aligned with said drain magnet and an open configuration situated proximate said right end such that the second actuation magnet is vertically aligned with drain magnet.

2. The oil drainage apparatus as in claim 1, wherein said plurality of walls of said housing includes a top wall and a bottom wall opposite the top wall and a continuous sidewall extending between said top wall and said bottom wall so as to together define said interior area, said continuous sidewall having a front wall section defining said selector channel.

3. The oil drainage apparatus as in claim 2, wherein:

said selector channel defines an imaginary horizontal axis;

said left end includes a left locking slot having a first imaginary vertical axis that is perpendicular to said imaginary horizontal axis;

said right end includes a right locking slot having a second imaginary vertical axis that is perpendicular to said imaginary horizontal axis and a right locking slot.

4. The oil drainage apparatus as in claim 3, wherein:

said left locking slot includes an upper end upwardly displaced from said imaginary horizontal axis of said selector channel; and said right locking slot includes an upper end upwardly displaced from said imaginary horizontal axis of said selector channel.

5. The oil drainage apparatus as in claim 4, wherein:

said continuous sidewall includes a back wall section opposite said front wall section;

said actuation lever having a rear end pivotally coupled to the back wall section of said continuous sidewall and having a front end extending through said selector channel to a point outside of said interior area; and said actuation lever includes a semi-flexible construction such that said front end is flexibly movable between a manually pressed configuration downwardly displaced from said upper end of said left locking slot or said right locking slot, respectively, and a released configuration naturally nested in said upper end of said left locking slot or said right locking slot, respectively.

6. The oil drainage apparatus as in claim 5, wherein said front end of said actuation lever is collinear with said imaginary horizontal axis when at said manually pressed configuration.

7. The oil drainage apparatus as in claim 1, wherein:

said connection member includes a tubular configuration defining an open top; and said oil drainage body includes a tubular configuration defining an open bottom in fluid communication with said open top of said connection member.

8. The oil drainage apparatus as in claim 1, wherein said drain magnet has a tubular configuration and is positioned in said common internal tubular space and includes an upper portion having an outer diameter equal to an inner diameter of said common internal tubular space so as to (1) block oil from flowing from the oil pan through said plurality of apertures into the common internal tubular space when said drain magnet is at said closed configuration and to (2) allow oil to flow from the oil pan through said plurality of apertures into the common internal tubular space when said drain magnet is at said open configuration.

9. The oil drainage apparatus as in claim 8, wherein said drain magnet includes a lower portion extending downwardly from said upper portion that has an outer diameter that is smaller than said inner diameter of said common internal tubular space such that oil is allowed to flow from the oil pan through said plurality of apertures into the comment internal tubular space when said drain magnet is at said open configuration.

10. The oil drainage apparatus as in claim 1, wherein:

said drain magnet polarity has a south pole directed downwardly;

said first actuation magnet has a north pole directed upwardly such that said drain magnet is magnetically urged downwardly in said common internal tubular space toward said closed configuration and said first actuation magnet when said first actuation magnet is aligned with said drain magnet;

said second actuation magnet has a south pole directed upwardly such that said drain magnet is magnetically repulsed and magnetically urged upwardly in said common internal tubular space toward said open configuration and away from said second actuation magnet when said second actuation magnet is aligned with that drain magnet.

11. An oil drainage apparatus for use with an engine that includes an oil pan and an oil drainage port that is threaded, said oil drainage apparatus, comprising:

a base member including a housing having a top wall and a bottom wall opposite the top wall and a continuous sidewall extending between said top wall and said bottom wall so as to, together, define said interior area, said continuous sidewall having a front wall section defining said selector channel;

wherein said selector channel extends laterally and is in communication with said interior area and is bounded by a left locking slot and the right locking slot opposite said left slot;

a connection member extending upwardly from said base member and having a plurality of external threads complementary to the threaded oil drainage port of the engine;

an oil drainage body extending upwardly from said connection member and having a continuous sidewall defining a plurality of apertures in fluid communication with the oil pan of the engine;

wherein said connection member and said oil drainage body defining and sharing a common internal tubular space in fluid communication with said interior area of said base member;

a drain magnet slidably movable in said common internal tubular space between a closed configuration blocking said plurality of apertures and an open configuration displaced from the plurality of apertures;

wherein said drain magnet includes a drain magnet polarity;

a first actuation magnet movably mounted in said interior area of said base member having a first predetermined polarity that is opposite to said drain magnet polarity;

the second actuation magnet movably mounted in said interior area of said base member having a second predetermined polarity that is the same as said drain magnet polarity;

an actuation lever pivotally mounted to a rear wall section of said continuous sidewall of said housing of said base member, said actuation lever having an elongate and linear configuration that extends outwardly through said selector channel and that is coupled to said first and second actuation magnets, said actuation lever being selectively and slidably movable in said selector channel between a closed configuration situated in said left locking slot at which the first actuation magnet is vertically aligned with said drain magnet and an open configuration situated in said right locking slot at which the second actuation magnet is vertically aligned with the drain magnet.

12. The oil drainage apparatus as in claim 11, wherein:

said selector channel defines an imaginary horizontal axis;

said left locking slot includes a first imaginary vertical axis that is perpendicular to said imaginary horizontal axis;

said right locking slot includes a second imaginary vertical axis that is perpendicular to said imaginary horizontal axis.

13. The oil drainage apparatus as in claim 12, wherein:

said left locking slot includes an upper end upwardly displaced from said imaginary horizontal axis of said selector channel; and said right locking slot includes an upper end upwardly displaced from said imaginary horizontal axis of said selector channel.

14. The oil drainage apparatus as in claim 13, wherein:

said actuation lever includes a rear end pivotally coupled to the back wall section of said continuous sidewall and includes a front end extending through said selector channel to a point outside of said interior area; and said actuation lever includes a semi-flexible construction such that said front end is flexibly movable between a manually pressed configuration downwardly displaced from said upper end of said left locking slot or said right locking slot, respectively, and a released configuration naturally nested in said upper end of said left locking slot or said right locking slot, respectively.

15. The oil drainage apparatus as in claim 14, wherein said front end of said actuation lever is collinear with said imaginary horizontal axis when positioned at said manually pressed configuration.

16. The oil drainage apparatus as in claim 11, wherein:

said connection member includes a tubular configuration defining an open top; and said oil drainage body includes a tubular configuration defining an open bottom in fluid communication with said open top of said connection member.

17. The oil drainage apparatus as in claim 11, wherein said drain magnet has a tubular configuration and is positioned in said common internal tubular space and includes an upper portion having an outer diameter equal to an inner diameter of said common internal tubular space so as to (1) block oil from flowing from the oil pan through said plurality of apertures into the common internal tubular space when said drain magnet is at said closed configuration and to (2) allow oil to flow from the oil pan through said plurality of apertures into the common internal tubular space when said drain magnet is at said open configuration.

18. The oil drainage apparatus as in claim 17, wherein said drain magnet includes a lower portion extending downwardly from said upper portion and has an outer diameter that is smaller than said inner diameter of said common internal tubular space such that oil is allowed to flow from the oil pan through said plurality of apertures into the comment internal tubular space when said drain magnet is at said open configuration.

19. The oil drainage apparatus as in claim 11, wherein:

said drain magnet polarity has a south pole directed downwardly;

said first actuation magnet has a north pole directed upwardly such that said drain magnet is magnetically urged downwardly in said common internal tubular space toward said closed configuration and toward said first actuation magnet when said first actuation magnet is aligned with said drain magnet;

said second actuation magnet has a south pole directed upwardly such that said drain magnet is magnetically repulsed and magnetically urged upwardly in said common internal tubular space toward said open configuration and away from said second actuation magnet when said second actuation magnet is aligned with that drain magnet.

* * * * *